United States Patent [19]

Christine et al.

[11] Patent Number: 4,779,397

[45] Date of Patent: Oct. 25, 1988

[54] APPARATUS AND METHOD FOR ATTACHING A FITMENT TO A WEB OF FILM

[75] Inventors: William C. Christine, Nazareth; George J. Herschman, Bath; William R. Haas, Nazareth, all of Pa.

[73] Assignee: Baxter Travenol Laboratories, Inc., Deerfield, Ill.

[21] Appl. No.: 23,187

[22] Filed: Mar. 9, 1987

[51] Int. Cl.[4] ..... B65B 61/00; B65B 61/18

[52] U.S. Cl. ..... 53/410; 53/412; 53/128; 53/133

[58] Field of Search ..... 53/128, 133, 410, 412, 53/451, 551; 493/212, 213, 923

[56] References Cited

U.S. PATENT DOCUMENTS

| | | | |
|---|---|---|---|
| 3,434,908 | 3/1969 | MacDonald | 53/410 |
| 3,783,080 | 1/1974 | Goglio | 53/410 |
| 3,812,572 | 5/1974 | Weikert | 53/410 |
| 3,821,046 | 6/1974 | Runge | 53/410 |
| 3,868,891 | 3/1975 | Parish | 53/410 |
| 3,886,714 | 6/1975 | de la Poype | 53/410 |
| 3,894,381 | 7/1975 | Christine et al. | 53/410 |
| 3,909,340 | 9/1975 | Solbeck | 53/410 |
| 4,055,032 | 10/1977 | Hammond | 53/410 |
| 4,118,913 | 10/1978 | Putnam, Jr. et al. | 53/410 |
| 4,166,412 | 9/1979 | Versteege | 53/410 |
| 4,246,062 | 1/1981 | Christine | 53/410 |
| 4,277,302 | 7/1981 | Reid | 53/410 |
| 4,326,574 | 4/1982 | Pallaroni et al. | 53/410 |
| 4,442,656 | 4/1984 | Wylie, Sr. | 53/551 |
| 4,451,249 | 5/1984 | deBin | 493/204 |
| 4,532,753 | 8/1985 | Kovacs | 53/451 |
| 4,533,425 | 8/1985 | Wehle | 493/213 |
| 4,566,250 | 1/1986 | Matsumura et al. | 53/410 |
| 4,603,536 | 8/1986 | de la Poype | 53/410 |
| 4,695,337 | 9/1987 | Christine | 53/578 |

FOREIGN PATENT DOCUMENTS 8116 1/1968 Australia .

*Primary Examiner*—Horace M. Culver

*Attorney, Agent, or Firm*—Robert M. Barrett; Mary R. Jankousky; Paul C. Flattery

[57] ABSTRACT

An apparatus for attaching fitments a web of film. The apparatus includes an elongated tube, the web of film being passed around at least a portion of the elongated tube. A film puncher and remover for punching at least one hole in the web of film and removing the resultant slug is provided. The web of film passes between the elongated tube and the film puncher and remover. The apparatus also includes a fitment feed member for feeding a fitment from outside the elongated tube to a fitment pick-up position inside the elongated tube. The elongated tube also includes a fitment moving member for moving the fitment from the fitment pick-up position to a fitment attachment position. The fitment attachment position is located so that a portion of the fitment is received by the hole in the web of film. The apparatus also includes a sealer for welding the film to the fitment.

44 Claims, 3 Drawing Sheets

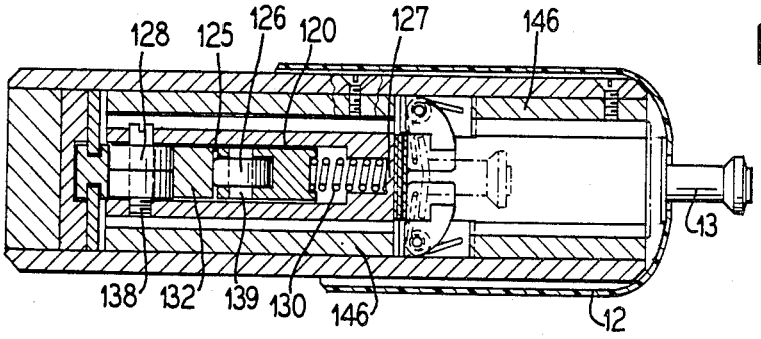
FIG. 5
FIG. 4
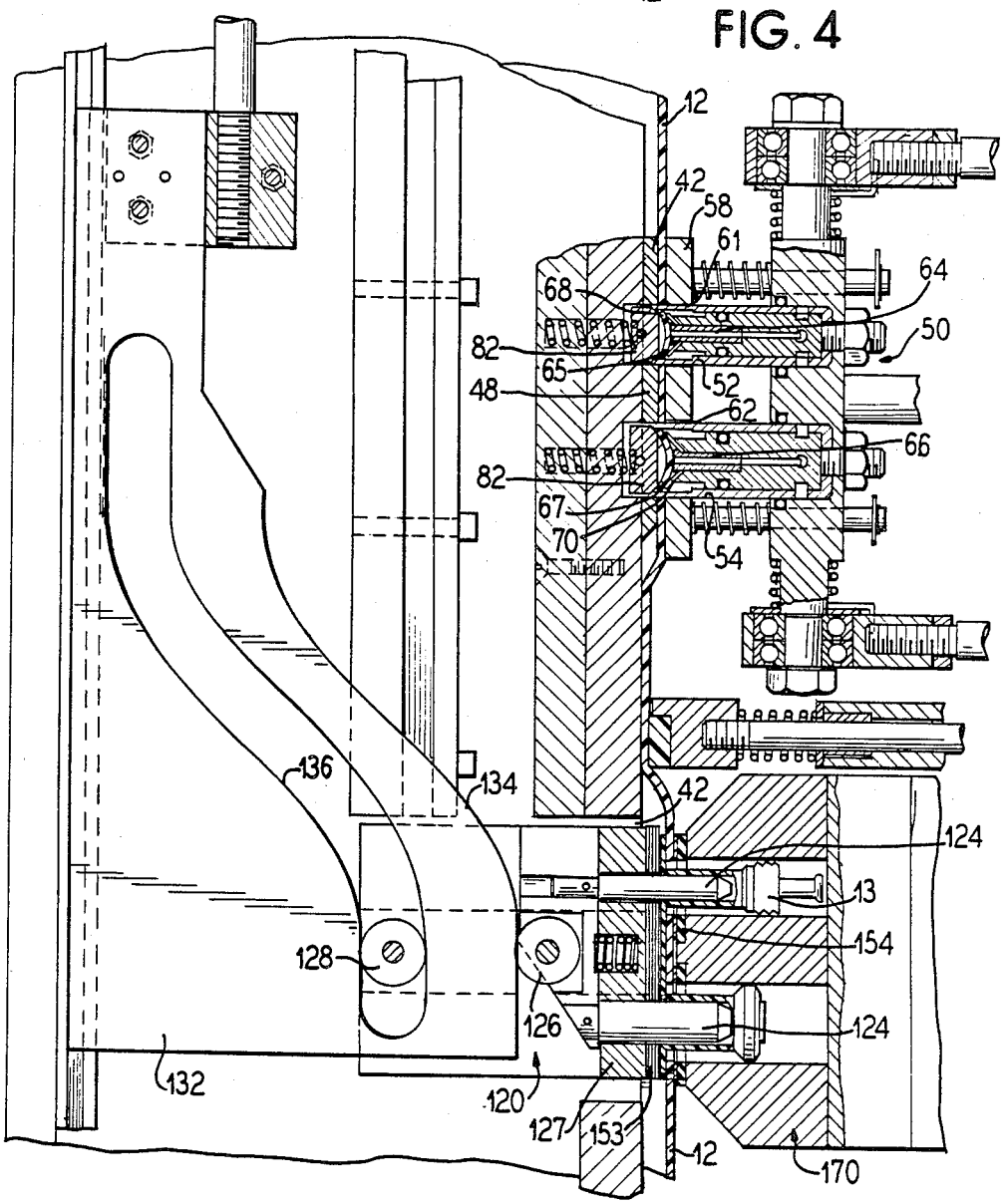

APPARATUS AND METHOD FOR ATTACHING A FITMENT TO A WEB OF FILM

DESCRIPTION

In general, this invention relates to an apparatus and method for attaching a fitment to a web of film. In particular, the present invention relates to an apparatus and method for attaching a fitment to a web of film in a form, fill and seal packaging machine so that flexible containers with fitments are produced.

In some types of packaging including, *inter alia,* pharmaceutical, food products, and dairy products, it is desirable to make flexible containers that include means for accessing the container (hereinafter "fitments"). As used herein, the term fitments includes, without limitation, valves, ports, port and closure assemblies, and other means for accessing a container. Fitments provide a means for establishing fluid communication between the container and the outside environment. An example of a container utilizing a fitment is the VIAFLEX® flexible container for parenteral solutions produced by Travenol Laboratories, Inc., Deerfield, Ill.

Flexible containers with fitments can be produced by form, fill and seal packaging machines. Form, fill and seal packaging machines provide an apparatus for forming a web of film into a flexible container housing a desired product. Typically, these machines include a former or mandrel, a fill tube, and heat sealers. The former or mandrel forms or folds the web of film into a tubular shape around a fill or film tube. The film tube is utilized to dispense the material to be packaged into the tubular shaped web of film.

In a typical form, fill and seal packaging machine, fitments are attached via an impulse heat sealing system. Usually, the impulse heat sealing system utilizes a ring heating element that has a shape substantially similar to the flange portion of the fitment. The impulse heat sealing system melts a portion of the web of film to the flange of the fitment.

Typically, fitment attaching apparatus are hardware intense and accordingly generate particulate matter. Moreover, the fitment attaching apparatus are usually located within the form, fill and seal machine in such a position that it is possible for particulate matter generated by the apparatus to find its way into the final product. This can be an especially critical problem in the pharmaceutical industry.

An additional problem that has been encountered in the packaging industry in the attachment of fitments to a web of film in a form, fill and seal packaging machine relates to the punching of a hole in the web of film before the fitment is sealed thereto. In one type of form, fill and seal packaging machine, the film is punched before the fitment is attached. This creates two concerns: (1) the removal of the plastic slug that is punched; and (2) insuring that the machine is correctly indexed so that the fitment is aligned with the punched hole.

Moreover, typically, form, fill and seal packaging machines are not very versatile. Usually, the machines are designed to create only one size container, e.g., one liter, two liter, etc. Modifying the machine to create a different size container is usually difficult and very time consuming, if possible. Accordingly, if one needs to create a variety of different size containers one must typically have a plurality of machines.

Thus, there is a need for a fitment attaching apparatus and method that overcomes the problems of the prior art.

An apparatus for attaching fitments to a web of film is provided. The apparatus includes an elongated tube, the web of film being passed around at least a portion of the elongated tube, and a film puncher and remover for punching at least one hole in the web of film and removing the resultant slug. The web of film passes between the elongated tube and the film puncher and remover. The apparatus also includes a fitment feed member for feeding a fitment from a first position to a fitment pick-up position inside the elongated tube. The elongated tube also includes a fitment moving member for moving the fitment from the fitment pick-up position to a fitment attachment position. The fitment attachment position is located so that a portion of the fitment is received within the hole in the web of film. The apparatus also includes a sealer for welding the film to the fitment.

Preferably, the fitment moving member is a shuttle having two cam followers and at least one pin. Preferably, the elongated tube includes a cam plate that cooperates with the cam followers to cause the pin to extend from the shuttle and the shuttle to move the fitment from the fitment pick-up position to the fitment attachment position. Preferably, the shuttle also functions as the back-up member for the fitment sealer.

Preferably, the elongated tube includes at least one spring biased cushion die. Preferably, the film puncher and remover includes a cutting element and vacuum line, and the spring biased cushion die cooperates with the film puncher and remover to urge the resultant slug against the vacuum line. The apparatus includes a disposal member for cooperating with the vacuum line to dispose of the resultant slug.

A method of creating flexible containers with fitments is also disclosed. The method comprises the steps of passing a web of film at least partially around an elongated housing tube, moving a fitment from a fitment storage position outside the elongated housing tube to a fitment pick-up position within the elongated housing tube, punching a hole in the web of film, removing a resultant slug, advancing the punched film to a fitment attachment station, moving the fitment from the fitment pick-up position to a fitment attachment position, and sealing the web of film to the fitment.

Accordingly, an advantage of the present invention is to provide an improved apparatus for attaching fitments to a web of film.

A further advantage of the present invention is to provide a method of attaching fitments to a web of film that limits the amount of particulate matter that can contaminate the final product.

Additionally, an advantage of the present invention is to provide an apparatus for attaching fitments that produces a final product with good seal integrity.

Furthermore, an advantage of the present invention is to provide an apparatus for attaching fitments that cooperates with the remaining components of the form, fill and seal packaging machine to produce the necessary precision to insure reliability of the machine and product created.

A still further advantage of the present invention is that the apparatus for attaching fitments comprises a reduced number of mechanisms.

Another advantage of the present invention is to provide an apparatus for attaching fitments to a web of film that can produce a variety of sizes of bags by simply varying the location of one or two parts of the apparatus.

Moreover, an advantage of the present invention is to provide an apparatus for punching a hole in a web of film and insuring that the resultant slug is removed and accordingly does not contaminate the final product.

A still additional advantage of the present invention is that the film is registered one station away from where the film is punched.

A further advantage of the present invention is that the apparatus for punching and sealing the web of film to the web of film is modular and can be easily removed and replaced.

Additionally, an advantage of the present invention is that the apparatus utilizes simple mechanisms that generate a minimal amount of particulate matter.

Furthermore, an advantage of the present invention is that the apparatus can be easily cleaned and maintained.

A still additional advantage of the present invention is that the apparatus for attaching fitments to a web of film can be modified to be utilized in an aseptic form, fill and seal packaging machine.

Another advantage of the present invention is that the shuttle for moving the fitment from the fitment pick-up position to the fitment attachment position has a stroke that matches the indexing of the film.

Moreover, an advantage of the present invention is that the fitment attaching apparatus is designed to cooperate with the form, fill and seal packaging machine to create flexible containers for housing products for the medical industry.

Additional features and advantages are described in, and will be apparent from, the detailed description of the presently preferred embodiments and from the drawings.

FIG. 4 illustrates a cross-sectional view of a portion of the apparatus for attaching fitments of FIG. 1, illustrating the film being punched and the fitments being sealed to the film.

FIG. 5 illustrates a top elevational view of a portion of the apparatus for attaching fitments taken along lines V—V of FIG. 2.

Figures 1, 6:
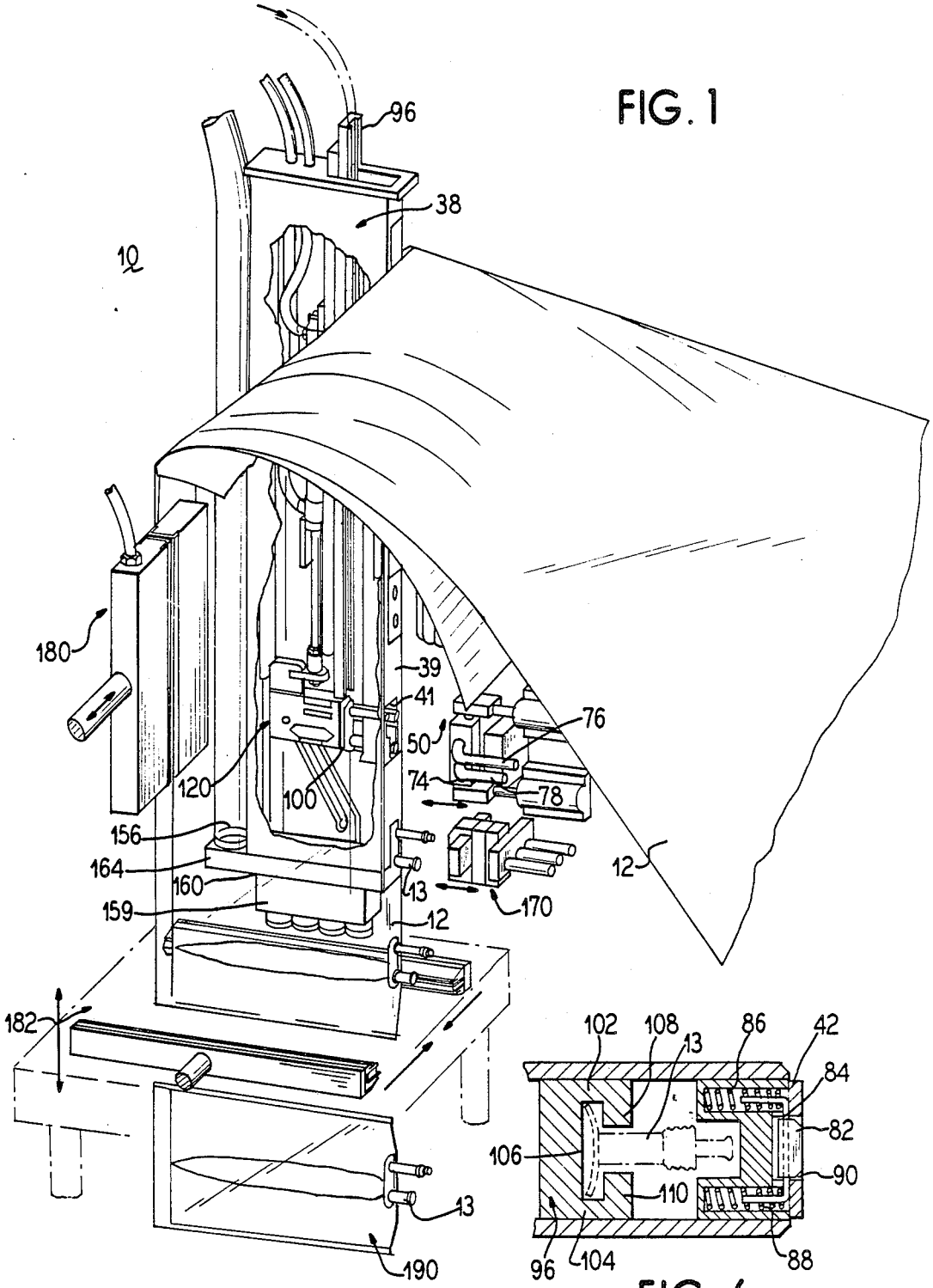
FIG. 1 illustrates a side elevational schematic view, with parts broken away, of the apparatus for attaching fitments of the present invention.
FIG. 6 illustrates a cross-sectional view of the gravity feed track and a spring cushion die taken along lines VI—VI of FIG. 2.

Referring to FIG. 1, the apparatus for attaching fitments 10 of the present invention is illustrated. The apparatus for attaching fitments 10 is preferably designed for use in a form, fill and seal packaging machine to create flexible containers having attached fitments. As used herein, the term "form, fill and seal packaging machine" means a packaging machine for creating from a web of film a flexible container filled with a product. In a typical form, fill and seal packaging machine the web of film is folded along abutting longitudinal edges and sealed onto itself. The film is then filled with a product and side seals are created. Of course, the apparatus for attaching fitments 10 of the present invention can be used in other packaging machines or with other apparatus to create containers with fitments.

Figures 2, 3:
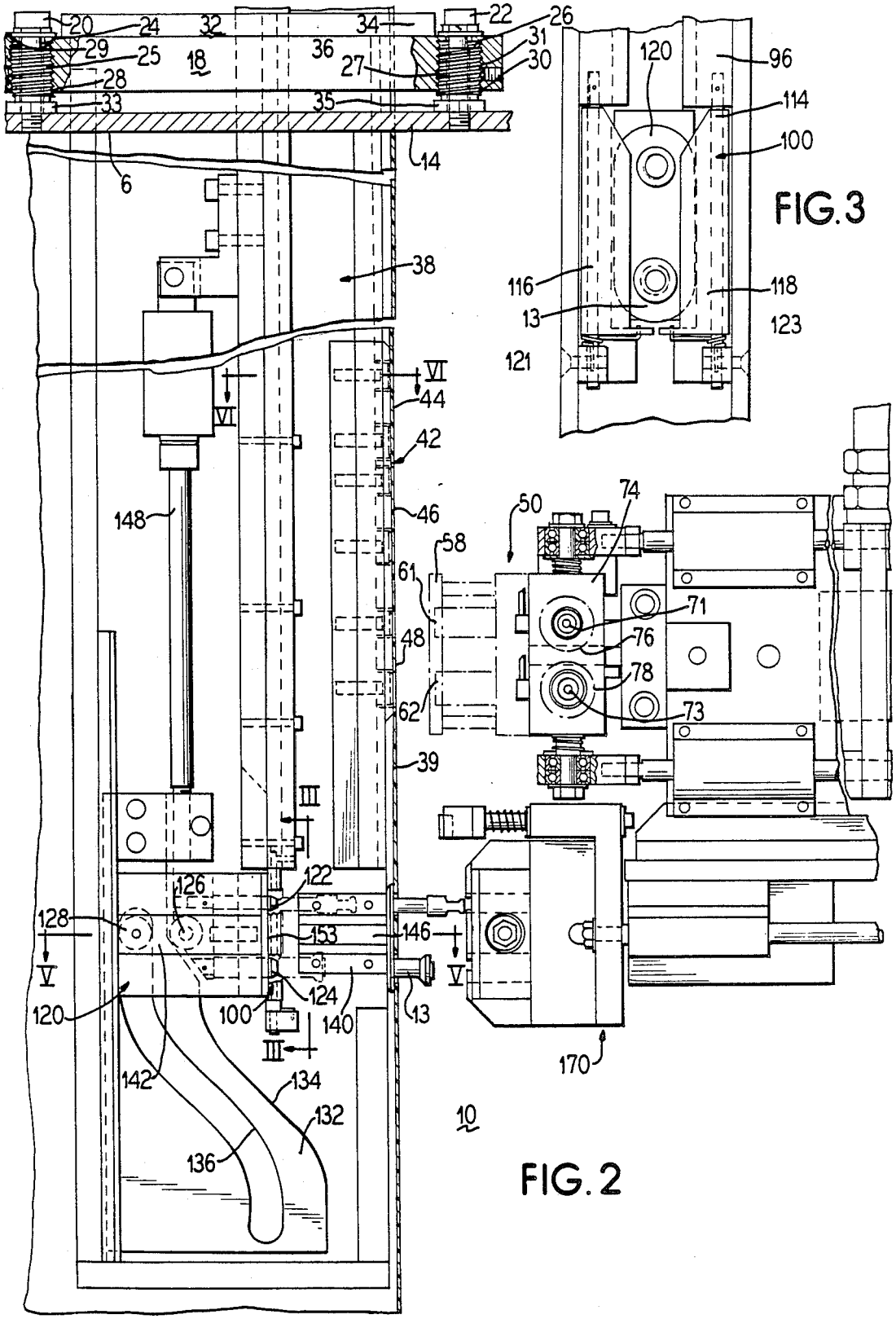
FIG. 2 illustrates a cross-sectional view of a portion of the apparatus for attaching fitments to FIG. 1.
FIG. 3 illustrates a front cross-sectional view of a portion of the apparatus for attaching fitments taken along lines III—III of FIG. 2.

In order to create a tubular shaped web of film, the web of film is typically passed over a mandrel or former that folds the film into a tubular shape. The apparatus for attaching fitments 10 is preferably located within the tubular shaped film and accordingly within the throat of the former or mandrel. To this end, as illustrated in FIG. 2, a top plate 14 of the frame of the form, fill and seal packaging machine includes a slot 16. The slot 16 is constructed so that the apparatus for attaching fitments 10 can be received and supported therein.

The apparatus for attaching fitments 10 includes a plate 18 that is designed to support the remaining portions of the apparatus for attaching fitments 10 in the form, fill and seal packaging machine. To this end, the plate 18 of the apparatus for attaching fitments 10 includes bolts 20 and 22 that are designed to be received within apertures 24 and 26 in the top plate 14 of the form, fill and seal machine. The plate also includes leveling legs 28 and 30. The leveling legs 28 and 30 function to insure that the apparatus for attaching fitments 10 is positioned in a level manner on the top plate 14 of the form, fill and seal machine. Due to the characteristics of steel, even if the utmost care is taken it is difficult to create a metal surface that is not warped to some extent. Accordingly, leveling legs 28 and 30 are necessary to insure that the apparatus for attaching fitments 10 is secured in the proper orientation within the form, fill and seal machine.

The leveling legs 28 and 30 comprise a sleeve that includes a threaded portion 25 and 27 that corresponds to the threaded aperture 29 and 31 in the plate 18. At an end of the threaded portion 25 and 27, each leveling leg 28 and 30 includes a nut member 33 and 35, respectively. By rotating the nut member 33 and 35 in a first direction the threaded portion 25 and 27 is caused to extend outwardly from the threaded portion 25 and 27 and accordingly the plate 18 is caused to move away from the top plate 14 of the machine. By rotating the nut 33 and 35 in a second direction, the threaded portion is caused to be received within the threaded aperture 29 and 31. To secure the threaded portion 25 and 27 securely within the threaded aperture set screws 37 may be utilized.

The plate 18 is removably secured to the remaining portions of the apparatus for attaching fitments 10 by a top plate 32. The top plate 32 includes bolts 34 that are received within apertures 36 in the plate 18. The top plate 32 and plate 18 include slots and bulkheads for the necessary electrical connections and air-lines.

As set forth above, the apparatus for attaching fitments 10 is removably secured within the form, fill and seal packaging machine. To remove the apparatus for attaching fitments 10 from the form, fill and seal machine, one merely has to remove the bolts 20 and 22 and lift the apparatus for attaching fitments 10 through the slot 16 in the top plate 14 of the packaging machine. This provides the user with the ability to change apparatus for attaching fitments 10 if the apparatus should malfunction or a part break. Moreover, it also provides the user with the ability to have a variety of such apparatus for attaching fitments 10 to satisfy different packaging needs.

Referring back to FIG. 1, the apparatus for attaching fitment 10 includes an elongated housing tube 38. Preferably, the housing tube 38 has an elongated rectangular shape. Of course, the housing tube 38 can have other shapes. The housing tube 38 is sized to limit any movement of the tube within the form, fill and seal machine due to the forces that are applied to the tube. The housing tube 38 preferably is constructed from stainless steel. Stainless steel 316-L steel has been found acceptable by the Food and Drug Administration for food and medical packaging uses. Preferably, the steel is high polished.

The housing tube 38 includes a front face 39 that is closed except for a slot 41. The slot 41 is dimensioned to allow the fitments 13 to exit the housing tube 38 and be sealed to the web of film 12. Referring to FIG. 2, the front face 39 of the housing tube 38 also includes a spring cushion die plate 42. The spring cushion die plate 42 functions, in part, to provide a backup member so that the web of film 12 can be pierced.

In the preferred embodiment illustrated, the spring cushion die plate 42 is constructed so that at least three different size bags can be constructed by the apparatus for attaching fitments 10. To this end, the spring cushion die plate 42 includes three sets of spring cushion dies 44, 46 and 48. As discussed in detail below, the first set of spring cushion dies 44 will be utilized if a three liter size bag is being created; the second set of spring cushion dies 46 will be utilized if a two liter bag is being created; and the third set of spring cushion dies 48 will be utilized if a one liter bag is being created. By varying the location, i.e., the set of spring cushion dies 44, 46 and 48, at which the web of film 12 is pierced, three different size bags can be created by the apparatus for attaching fitments 10. Of course, by adding additional spring cushion dies additional sizes of bags can be created.

The apparatus for attaching fitments 10 also includes a film puncher and remover 50. The film puncher and remover 50 functions to punch holes in the web of film 12 so that the fitments 13 can be inserted therein. As discussed in detail below, after the fitments 13 are inserted through the holes in the web of film 12 the fitments are sealed thereto. The film puncher and remover 50 is located exactly one bag length, i.e., one stroke, above the heat seal station 170 of the apparatus for attaching fitments 10.

As illustrated in FIG. 4, the film puncher and remover 50 includes two cutting elements 52 and 54. The cutting elements 52 and 54 are designed to extend outwardly from the film puncher and remover 50 and cut the web of film 12. The cutting elements 52 and 54 are preferably hollow having a cylindrical cross-sectional shape; accordingly the hole that they punch is cylindrically shaped. In a preferred embodiment, the cutting elements 52 and 54 include teeth (not shown). Of course, the cutting elements 52 and 54 can be constructed so that they do not include teeth but rather have some other construction that insures that they cut through the web of film 12, e.g., a conical flat, apple core, or angled shape with or without teeth. The cutting elements 52 and 54 are constructed so that they can punch a hole in a variety of films including nylon enforced film.

The film puncher and remover 50 also includes a spring bias plate 58. The spring bias plate 58 includes apertures 61 and 62. It is through the apertures 61 and 62 that a portion of the cutting elements 52 and 54 extend when the cutting elements 52 and 54 cut the web of film 12. As the film puncher and remover 50 is actuated and driven against the web of film 12 the plate 58 is driven backward. Conversely, the cutting elements 52 and 54 extend outwardly through the apertures 61 and 62 in the spring biased plate 58 cutting the web of film 12.

The spring biased plate member 58 also functions to put the web of film 12 under tension in the area of the punch. To this end, the spring biased plate 60 functions to cause the film 12 to stay in tension across the opening of the apertures 61 and 62 so that the film 12 does not tent under the cutting elements 52 and 54; this provides a drum head effect.

Located within the cylindrical cutting elements 52 and 54 are vacuum lines 64 and 66. The vacuum lines 64 and 66 function to hold the resultant slugs 65 and 67 that are cut from the web of film 12 by the cutting elements 52 and 54. It is especially important in the medical industry, as well as other applications, that the resultant slugs 65 and 67 do not contaminate the product being created. Accordingly, the vacuum lines 64 and 66 provide a method of insuring that the resultant slugs 65 and 67 do not contaminate the final product.

In use, as illustrated in FIG. 4, as the cutting elements 52 and 54 cut the web of film 12 the vacuum lines 64 and 66 are urged against the resultant slugs 65 and 67. The vacuum pressure exerted by the vacuum lines 64 and 66 causes the resultant slugs 65 and 67 to remain against the vacuum lines within the hollow cutting elements 52 and 54. To aid in retaining the resultant slugs 65 and 67, as illustrated, the vacuum lines 64 and 66 may include rubber dishes 68 and 70.

Referring back to FIG. 2, after the cutting elements 52 and 54 of film puncher and remover 50 have punched holes in the web of film 12, the film puncher and remover 50 is then moved away from the web of film 12. As the film puncher and remover 50 is moved away from the web of film a cam system (not illustrated) causes the film puncher and remover 50 to rotate so that the vacuum lines 64 and 66 face a slug takeaway station 74. The cam system can be any cam system known in the art that causes the film puncher and remover 50 to rotate as it retracts. Of course, other means for causing the vacuum lines 64 and 66 to face the slug takeaway station 74 can be utilized.

The slug takeaway station 74 functions to remove the slugs from the vacuum lines 64 and 66 of the film puncher and remover 50. To this end, the slug takeaway station 74 includes apertures 71 and 73 for receiving the resultant slugs 65 and 67. The apertures are constructed so that they can receive the slugs from the vacuum lines 64 and 66. To this end, the film puncher and remover 50 is rotated so that the vacuum lines 64 and 66 are moved in juxtaposition to the apertures 71 and 73. The puncher and remover 50 is then oriented so that the slugs 65 and 67 are trapped between the apertures 71 and 73 and the vacuum lines 64 and 66. When the slugs are so trapped, vacuum lines 76 and 78 are then activated and exert a vacuum pressure against the resultant slugs 65 and 67. At the same time, the vacuum pressure in the vacuum lines 64 and 66 is reversed so that the vacuum lines 64 and 66 now exert a positive force pushing the slugs into the apertures 71 and 73 and the vacuum lines 76 and 78.

From the vacuum lines 76 and 78 the resultant slugs 65 and 67 move into a waste reservoir (not shown). As needed, the waste reservoir can be cleaned to remove the slugs.

The film puncher and remover 50 is constructed so that it provides an apparatus that allows one to check to see if the resultant slugs 65 and 67 have actually been removed by the vacuum lines 64 and 66. To this end, the puncher and remover 50 includes a vacuum switch (not shown). It has been found that a vacuum switch available from Micro Switch and a proximity ring available from Electro Corporation functions satisfactorily.

In order to insure that the slugs are removed by the vacuum lines 64 and 66, one determines what the vacuum reading should be with a slug 65 or 67 secured to the vacuum lines 64 and 66 and then randomly samples the vacuum pressure in the vacuum lines 64 and 66, through the vacuum switch, during the cycle times when the slugs 65 and 67 should be held by the vacuum lines 64 and 66. If the pressure is too low, i.e., if the vacuum lines 64 and 66 are open, then one knows that the resultant slugs 65 and 67 have been lost somewhere in the process. The form, fill and seal packaging machine can then be shut down to insure that contaminated products are not produced. If desired, it is also possible to utilize photoelectric cells in the vacuum lines 76 and 78 to determine if the resultant slugs 65 and 67 have passed through the vacuum lines 76 and 78 into the waste reservoir.

Preferably, the pressure of the vacuum lines 64 and 66 should be approximately 28 to about 30 inches. The vacuum pressure of the vacuum lines 76 and 78 should be approximately 28 to about 30 inches.

The vacuum lines 64 and 66 and vacuum lines 76 and 78 can be connected to any vacuum pump known in the art. Preferably, the vacuum lines 76 and 78 are constructed so that the vacuum lines 76 and 78 do not exert a constant vacuum force. This is preferred in order to reduce the noise of the form, fill and seal packaging machine and torreduce operating cost. This can be easily accomplished by utilizing a valve that can actuate the vacuum at the appropriate time. The valve can be controlled by a micro switch.

The film puncher and remover 50 is synchronized with the other operations of the form, fill and seal packaging machine. To this end, the web of film 12 is punched by the puncher and remover 50 during the dwell cycle of the form, fill and seal packaging machine. Accordingly, it is also necessary for the remaining functions of the film puncher and remover 50 to be performed before the next dwell of the form, fill and seal machine, i.e., retract, rotate, discharge, rotate, and extend.

The film puncher and remover 50 is located so that it corresponds to the specific set of spring cushion dies 44, 46 and 48 corresponding to the size of the bag desired to be made, e.g., one liter, two liter, etc. The film puncher and remover 50 is mechanically attached to the frame of the packaging machine so that it can be repositioned by removing a pin (not shown) Accordingly, by removing the pin, the film puncher and remover 50 can be repositioned to correspond to another set of spring cushion dies 44, 46 and 48, and the pin can then be reinserted securing the film puncher and remover in place. The slug takeaway station 74 is also secured to the same frame as the film puncher and remover 50 and accordingly will be repositioned with the film puncher and remover 50.

Referring now to FIG. 6, a spring cushion die 44 is illustrated. Although only one spring cushion die 44 is illustrated, the remaining sets of spring cushion dies 46 and 48 have similar constructions. The spring cushion die 44 includes a die member 82 that is situated on a steel shaft 84 that is biased by two spring members 86 and 88. Accordingly, the die member 82 is spring biased within an aperture 90 in the spring cushion die plate 42. The steel shaft 84 prevents the die member 82 from exiting the aperture 90 in the spring cushion die plate 42. Preferably, the die member 82 is constructed from a hard plastic.

Because, preferably, the film puncher and remover 50 punches two holes in the web of film 12 per cycle of the form, fill and seal packaging machine, each set of spring cushion die members 44, 46 and 48 includes two die members 82. Of course, if only one hole is to be punched in the web of film 12, only one die member 82 would be needed per set of spring cushion die members 44, 46 and 48. Likewise, if a fitment is to be attached having more than two ports, and accordingly, more than two holes must be punched per each cycle, each set of spring cushion die members 44, 46 and 48 can include more than two die members 82.

As previously stated, in order to cut the web of film 12, the film puncher and remover 50 is actuated so that the cutting elements 52 and 54 extend outwardly through the plate 58 cutting the web of film 12. To allow the film puncher and remover 50 to cut the web of film 12, the spring cushion dies 44, 46 and 48 function as backup members. Specifically, the die member 82 acts as the backup member, and is urged inwardly by the cutting elements 52 and 54.

Moreover, the spring cushion die 44 also cooperates with the film puncher and remover 50 to ensure that the resultant slug is removed. To this end, as illustrated in FIG. 4, the film 12 is punched by the cutting elements 52 and 54, the die member 82, exerts an outward pressure causing the resultant slug to be pressed against the vacuum lines 64 and 66 as the film 12 is cut by the cutting elements 52 and 54.

As illustrated in FIG. 1, the fitments 13 are fed from outside the housing tube 38 into the tube. To accomplish this, the form, fill and seal apparatus includes a feeder bowl (not shown) and a transfer device (not shown). The feeder bowl can be any feeder bowl known in the art that functions to store fitments 13 and transfer them to a transferring device. The transfer device can be any transferring device known in the art that functions to bring the fitments 13 from the feeder bowl to a position where the fitments can be fed to the gravity feed track 96. The transfer device can include a transfer track and fitment transfer apparatus. The transfer device can also include a photoelectric eye to index the transfer of the fitments 13 from the feeder bowl to the transfer device.

The transfer device may include a guidewire located between the gravity feed track 96 and transfer device to transfer the fitments 13 from the transfer device to the gravity feed track. Preferably, the fitments 13 are transferred to the gravity feed track 96 one at a time at intervals equal to the cylce time of the form, fill and seal machine. However, it is possible to transfer the fitments 13 to the gravity feed track 96 without waiting for the cycling time of the form, fill and seal machine allowing the fitments to backup on the gravity feed track 96.

Of course, any means known in the art of storing and transferring the fitments 13 can be utilized, depending on the use of the form, fill, and sealing packaging machine. By way of example, the following commercially available feeder bowl and transfer device can be used; Moorfeed Model #72400 and Transfer, device provided by Inpaco, Inc. of Nazareth, Pa. U.S.A.

The fitments 13 are moved from the transfer device to a gravity feed track 96. The gravity feed track 96 extends from a top of the housing tube 38 to a fitment pick-up position at a shuttle station 100. As will be discussed in more detail below, located at the fitment pick-up position is a shuttle 120 that functions to move the fitment 13 from the fitment pick-up position to a fitment attachment position. To this end, the shuttle 120 functions to insert the fitment 13 through the punched web of film 12.

As its name implies, the gravity feed track 96 feeds the fitments 13 to the shuttle station 100 by allowing the fitments to freefall down the track. To this end, the gravity feed track 96 is constructed so that the fitments 13 freefall to the greatest extent possible. This is important because it is necessary for the fitments 13 to be transferred from the transfer device and freefall down the gravity feed track 96 to the shuttle station 100 before the next stroke of the machine begins. In the preferred embodiment illustrated, the approximate total stroke time of the form, fill and seal machine is three seconds. It has been found, that the gravity feed track 96 of the present invention allows the fitments 13 to fall from a first position at the top of the elongated tube 38 to the shuttle station 100 within approximately one half second.

As illustrated in FIG. 6, the gravity feed track 96 includes side members 102 and 104 and a bottom portion 106. The side members 102 and 104 of the gravity feed track 96 include top flanges 108 and 110. The top flanges 108 and 110 and side members 102 and 104 cooperate to secure the fitments 13 within the gravity feed track 96 as they free fall down the gravity feed track 96.

Because proper attitude of the fitment 13 is required, it may be desired or necessary to add a center projection to the bottom portion 106 of the gravity feed track 96. This may be especially desirable with fitments 13 that are preformed.

Preferably, the tolerances of the gravity feed track 96 with respect to the fitments 13 are opened as much as possible; this provides a better free fall. The length of the gravity feed track 96, and accordingly the distance the fitments 13 may be stored from the shuttle station 100, is directly related to the speed of the free fall of the fitments. Of course, the fitments 13 can be delivered to the shuttle station 100 by some sort of mechanical delivery system if desired.

The gravity feed track 96 is mechanically fixed between the sides of the housing tube 38. To this end, the gravity feed track 96 is secured between the sides of the housing tube 38 by screws or other means for fixing the gravity feed track 96 to the sides of the housing tube 38.

The gravity feed track 96 is preferably constructed from stainless steel. Preferably, the gravity feed track 96 is constructed from 316-L stainless steel that is high-polished. It has been found that high polished stainless steel provides a sufficiently low coefficient of friction.

As illustrated in FIGS. 2 and 3, from the gravity feed track 96 the fitments 13 move to the shuttle station 100, i.e., the fitment pick-up position. The shuttle station 100 includes a track 114 that is defined, in part, by swing doors 116 and 118. The swing doors 116 and 118 include stop members 121 and 123, respectively, that function to support the fitments 13 in the track 114 between the swing doors 116 and 118. Once the fitment 13 is secured between the swing doors 116 and 118 it can then be positioned by the shuttle 120.

Referring now to FIGS. 2, 4 and 5, the shuttle 120 includes a pin plate 127 having a top pin 122 and a bottom pin 124. The top pin 122 corresponds to the top opening in the fitment 13 and the bottom pin 124 corresponds to the bottom opening in the fitment 13. Accordingly, the top and bottom pins 122 and 124 respectively are designed to be received within the openings of the fitment 13. To this end, the top and bottom pins 122 and 124 have a shape that conforms to the shape of the inner diameter of the openings of the fitment. If desired, a vacuum line can be run into the shuttle 120, and specifically pins 122 and 124, and pin holes can be located in the pins 122 and 124 to secure the fitment on the shuttle 120.

The shuttle 120 includes a center portion 125 having a first cam follower 126 and a second cam follower 128. The first cam follower 126 is designed to cause the top and bottom pins 122 and 124 to enter a portion of the fitment 13. To this end, a spring member 130 is located behind the pin plate 123 and in front of first cam follower 126. When the cam follower 126 moves, the spring member 130 causes the pin plate 123, and specifically the top and bottom pins 122 and 124 to move outwardly into the fitment 13. The second cam follower, as will be described in more detail hereinafter, is designed to provide lateral movement to the shuttle 120.

The shuttle 120 is positioned around a cam plate 132. Accordingly, the first and second cam followers 126 and 128 of the shuttle 120 are located on a cam plate 132. The first cam follower 126 is located on the face 134 of the cam plate 132 while the second cam follower 128 is located within a cam track 136 in the cam plate. Accordingly, the first cam follower 126, follows the face 134 of the cam plate 132 and the second cam 128 follows the cam track 136. Thus, the shuttle 120 and cam plate 132 defines a two cam system.

Preferably, the cam followers 126 and 128 are constructed from flash hard chrome and are secured to the shuttle 120 by hardened pins 138 and 139. Moreover, preferably the cam followers 126 and 128 are constructed so that they rotate as they follow the cam plate 132; this insures that the cam followers 126 and 128 do not quickly wear. Preferably, the shuttle 120 is constructed from stainless steel, preferably 316-L.

Located on both interior sides of the housing tube 38 is a shuttle track 140. The shuttle track 140 provides a guide for the shuttle 120 as it moves laterally across the width of the elongated housing tube 38 urging the fitment 13 through the web of film 12. The shuttle 120 includes notches 142 on each of its sides that correspond to projections 146 on the shuttle track 140.

The top and bottom pins 122 and 124, respectively, of the shuttle 120 are spring biased by a spring 130. Accordingly, as discussed above, when the cam plate 132 is actuated the first cam follower 126 forces the pins 122 and 124 outwardly into the fitment 13. After the cam plate 132 has moved a certain distance, and the pins 122 and 124 have been inserted into the fitment 13, the second cam follower 128 will then be actuated and will move the shuttle 120 laterally. To this end, as illustrated, the cam plate 132 is constructed so that during the first phase of its movement the first cam follower 126 will be actuated and during the second stage of the cam plate's movement both the first and second cam followers 126 and 128 will be urged laterally, as illustrated in FIG. 4. Preferably, the cam plate 132 defines a cyclodial curve.

The cam plate 132 is actuated by an air cylinder 148. The air cylinder 148 is matched to the stroke desired. The air cylinder 148 can be any air cylinder known in the art.

The shuttle 120 also functions as a backup member so that the web of film 12 can be heat sealed to the fitments 13. To this end, the shuttle 120 includes an elastomeric face 153. Preferably, the elastomeric face 153 is constructed from a heat-resistant silicon rubber.

Located diametric the slot 42 in the elongated housing tube 38 and shuttle 120 is the heat seal station 170. The heat seal station 170 includes a fitment weld head 154. The fitment weld head 154 functions to weld, by heat, the web of film 12 to the fitment 13. To this end, the weld head 154 may be any heat seal means known in the art. Preferably, the weld head 154 comprises two impulse heat seal rings. The heat seal rings should be dimensioned to accommodate the fitment 13. The fitment weld head 154 is situated in the form, fill and seal packaging machine as is known in the art. Of course, other means for sealing the web of film 12 to the fitment 13 can be utilized.

As stated above, the shuttle 120 acts as a backup member for the fitment weld head 154. Accordingly, the shuttle 120 and elastomeric face 153 are constructed so that the shuttle 120 cools down during the cycle time of the form, fill and seal packaging machine.

As illustrated in FIG. 1, the housing tube 38 is constructed so that the fill tube 156 of the form, fill and seal packaging machine can utilize the housing tube 38 as a support within the machine. To this end, as illustrated, the fill nozzles 159 can be located at the bottom 160 of the housing tube 38.

The housing tube 38 is constructed so that it reduces or limits the amount of particulate matter that will be deposited in the resultant product. In order to clean the particulate matter out of the housing tube 38, the housing tube 38 includes a removable bottom plate 164. To this end, the bottom plate 164 can be removed removably secured by screws, bolts or other means that secure the bottom plate to the remaining portion of the housing tube 38. The particulate matter generated can then be cleaned out from the bottom plate 164.

As illustrated in FIG. 1, the packaging apparatus of the present invention includes a top seal station 180 and side seal and cut-off station 182. The top sealer, means for severing, and side sealers can be any means known in the art for sealing and severing a web of film 12. After a fitment 13 has been sealed to a web of film 12, the film 12 with fitment sealed thereto can then be sealed on one of its sides. Fluid, or other product, from the fill nozzle 159 is then deposited into the film. A second side seal is then effectuated and the film is severed to create a flexible container 190.

It should be understood that various changes and modifications to the preferred embodiment described herein will be apparent to those skilled in the art. Such changes and modifications can be made without departing from the spirit and scope of the present invention and without diminishing its attendant advantages. It is therefore intended that such changes and modifications be covered by the appended claims.

We claim:

1. An apparatus for attaching fitments to a web of film comprising:

an elongated tube, the web of film passing around at least a portion of the elongated tube;

means for punching at least one hole in the web of film and for removing a resultant slug, the web of film passing between the tube and the means for punching and removing;

a fitment feed means for feeding a fitment from a first position in the elongated tube to a fitment pick-up position:

fitment moving means, located within the elongated tube, for moving the fitment from the fitment pick-up position to a fitment attachment position, a portion of the fitment being received within a hole in the web of film when the fitment is in the fitment attachment position;

means for sealing the web of film to the fitment and the fitment moving means including a backup member means for cooperating with the means for sealing so that the web of film is sealed to the fitment.

2. The apparatus of claim 1, wherein the fitment feed means includes a gravity feed track.

3. The apparatus of claim 1, wherein the means for punching and removing includes means for determining if the resultant slug has been removed.

4. the apparatus of claim 1 wherein the elongated tube includes a resilient means for providing a surface against which the means for purching and removing can punch a hole in the web of film.

5. An apparatus for attaching fitments to a web of film comprising:

an elongated tube, the web of film passing around at least a portion of the elongated tube;

means for punching at least one hole in the web of film and for removing a resultant slug, the web of film passing between the tube and the means for punching and removing:

a fitment feed means for feeding a fitment from a first position in the elongated tube to a fitment pick-up position;

fitment moving means, located within the elongated tube, for moving the fitment from the fitment pick-up position to a fitment attachment position, a portion of the fitment being received within a hole in the web of film when the fitment is in the fitment attachment position, the fitment moving means including a shuttle having two cam followers that cooperate with a cam plate located within the elongated tube to provide a two cam system; and means for sealing the web of film to the fitment.

6. The apparatus of claim 5, wherein:

the shuttle includes at least one pin member and a first of said cam followers cooperates with the cam to cause the pin to extend from a front face of the shuttle into an aperture in a fitment at the fitment pick-up position; and a second of said cam followers cooperates with the cam to cause the shuttle and the fitment to move from the front pick-up position to the fitment attachment position.

7. The apparatus of claim 6, wherein the cam plate defines a cyclodial curve.

8. An apparatus for attaching fitments to a web of film in a form, fill and seal packaging machine for making flexible containers with fitments comprising:

an elongated tube having a front face, the web of film passing around at least a portion of the elongated tube;

punching and removing means for punching at least one hole in the web of film and removing a resultant slug, the web of film passing between the punching and removing means and the front face of the elongated tube;

a fitment feed track for feeding the fitment from a first position to a fitment pick-up position in the elongated tube;

a shuttle, located in the elongated tube, for moving the fitment from the fitment pick-up position to a fitment attachment position, a portion of the fitment being inserted within a hole punched by the punching and removing means in the web of film when the fitment is in the fitment attachment position; and means for sealing the web of film to the fitment.

9. The apparatus of claim 8 wherein:

the shuttle includes at least one cam follower; and the elongated tube includes a cam plate that cooperates with the cam follower of the shuttle to cause the shuttle to move the fitment from the fitment pickup up position to the fitment attachment position.

10. The apparatus of claim 9 wherein:

the shuttle includes two cam followers and at least one spring biased pin; and the cam plate includes a cam face and a cam track, the cam face cooperating with a first cam follower to cause the pin to extend from the shuttle.

11. The apparatus of claim 10 wherein the cam face and cam track define a cyclodial curve.

12. The apparatus of claim 9 wherein the elongated tube includes shuttle guide tracks, the shuttle guide tracks cooperate with the cam plate to cause the shuttle to move from the fitment pick-up position to the fitment attachment position.

13. The apparatus of claim 9 wherein the shuttle cooperates with the means for sealing the web of film to the fitment.

14. The apparatus of claim 8 wherein the front face of the elongated tube includes a slot, the slot being located so that when the fitment is in the fitment attachment position at least a portion of the fitment extends from the slot.

15. The apparatus of claim 8 wherein the fitment pick-up position is defined by a pair of swing doors having stop members, the swing doors positioning the fitment so that it can be picked-up by the shuttle.

16. The apparatus of claim 15 wherein the feed track extends from a top of the elongated tube to a top of the swing doors.

17. The apparatus of claim 8 wherein the elongated tube includes a removable bottom plate.

18. The apparatus of claim 8 wherein:

the punching and removing means includes at least one cutting means for cutting the web of film; and the front face of the elongated member includes at least one spring biased cushion die for acting as a back-up member to the cutting means.

19. The apparatus of claim 18 wherein:

the punching and removing means includes vacuum means for retaining the resultant slug; and the spring biased cushion die includes means for urging the resultant slug towards the vacuum means.

20. The apparatus of claim 19 including a plurality of spring cushion dies.

21. The apparatus of claim 8 wherein the punching and removing means includes at least one hollow cutting element and at least one vacuum line located within the hollow cutting element, the hollow cutting element and vacuum line cooperating so that the hollow cutting element cuts the web of film and the vacuum line retains the resultant slug.

22. The apparatus of claim 20 wherein the punching and removing means includes means for determining if the resultant slug is retained by the vacuum line.

23. The apparatus of claim 21 wherein the elongated tube includes means for urging the resultant slug against the vacuum lines.

24. The apparatus of claim 21 including means for disposing of the resultant slug, the means for disposing cooperating with the vacuum line to remove the resultant slug from the vacuum line and dispose the resultant slug.

25. An apparatus for attaching fitments to a web of film to create flexible containers having fitments comprising:

an elongated housing tube having a closed face including a slot, the web of film passing around at least a portion of the elongated housing tube;

a film puncher and slug remover for punching holes in the web of film and removing resultant slugs, the web of film passing between the film puncher and slug remover and the face of the elongated housing tube, the film puncher and slug remover including at least one cutting element and at least one vacuum line;

a gravity feed track located at least partially within the elongated housing tube, the gravity feed track extending from a top of the elongated tube to a fitment pick-up position in the elongated tube, the gravity feed track feeding fitments from a top of the elongated housing tube to the fitment pick-up position;

a shuttle, located in the elongated housing tube, for moving the fitment from the fitment pick-up position to a fitment attachment position, at least a portion of the fitment extending from the slot when the fitment is in the fitment attachment position; and a fitment heat sealer, the fitment heat sealer cooperating with the shuttle to seal the web of film to the fitment at the fitment attachment position.

26. The apparatus of claim 25 wherein:

the shuttle includes at least one pin member and two cam followers;

the elongated housing tube includes a shuttle track for allowing the shuttle to move across at least a portion of the width of the elongated housing tube but preventing the shuttle from moving with respect to the length of the elongated housing tube; and the elongated housing tube including a cam plate, the cam plate cooperating with the shuttle to cause the shuttle to pick up the fitment at the fitment pick-up position and move the fitment to the fitment attachment position.

27. The apparatus of claim 26 wherein: the cam plate includes a cam face and a cam track, a first cam follower cooperating with the cam face to cause the pin member to extend from a face of the shuttle into an aperture in the fitment at the fitment pick-up position, and the second cam follower cooperating with the cam track to cause the shuttle to move the fitment from the fitment pick-up position to the fitment attachment position.

28. The apparatus of claim 27 wherein the cam face and cam track define a cyclodial curve.

29. The apparatus of claim 25 wherein the face of the elongated housing tube includes at least one spring biased die for cooperating with the film puncher and slug remover.

30. The apparatus of claim 29 wherein the spring biased die is urged into a portion of the elongated housing tube when the cutting element cuts the web of film and the spring biased die includes means for urging the slug against the vacuum line after the cutting element has cut the web of film.

31. The apparatus of claim 30 wherein:

the film puncher and slug remover includes two hollow cutting elements and two vacuum lines located within the hollow cutting elements; and the face of the elongated housing tube includes two corresponding spring cushion dies.

32. The apparatus of claim 30 wherein:

the face of the elongated housing tube includes a plurality of sets of spring cushion dies;

the film puncher and slug remover is removably secured with the elongated housing tube by a retaining means; and the spring cushion dies, film puncher and slug remover, and retaining means cooperate to produce a plurality of different size flexible containers with fitments.

33. The apparatus of claim 30 including a slug takeaway station, the slug takeaway station cooperating with the film puncher and slug remover to remove the slug from the vacuum line to a waste reservoir.

34. The apparatus of claim 30 wherein the film puncher and slug remover includes means for determining if the slug is retained by the vacuum line.

35. The apparatus of claim 25 wherein the elongated housing tube has a substantially rectangular shape.

36. The apparatus of claim 35 including:

a fill tube secured to a side of the elongated housing tube; and dispensing means for dispensing a product from the fill tube secured to a bottom of the elongated housing tube.

37. A method for attaching fitments to a web of film comprising the steps of:

passing a web of film at least partially around an elongated housing tube;

transferring a fitment from a fitment storage position outside the elongated housing tube to a fitment pick-up position within the elongated housing tube;

punching a hole in the web of film;

removing a resultant slug;

advancing the punched film to a fitment attachment station;

moving a shuttle located at the fitment attachment station by causing the shuttle to follow a cam plate causing the fitment to move from the fitment pick-up position to a fitment attachment position;

sealing the web of film to the fitment; and periodically cleaning particulate matter out of the elongated housing tube by removing a bottom plate from the elongated housing tube.

38. The method of claim 37 including the steps of transferring the fitment to the fitment pick-up position by allowing the fitment to fall down a gravitvy feed track.

39. The method of claim 37 including the steps of urging the resultant slug against a vacuum line for removing the resultant slug.

40. The method of claim 37 including the steps of disposing of the resultant slug.

41. The method of claim 37 including the steps of passing a portion of the fitment through holes punched in the web of film.

42. The method of claim 37 including the steps of:

sealing a top portion of the web of film;

sealing one side of the web of film after a fitment has been attached thereto;

filling the resultant sealed web of film with a product;

sealing a second side of the web of film; and severing the sealed film from the remaining portions of the film.

43. A method for attaching fitments to a web of film comprising the steps of:

passing a web of film at least partially around an elongated housing tube;

transferring a fitment from a fitment storage position outside the elongated housing tube to a fitment pick-up position within the elongated housing tube;

punching a hole in the web of film;

removing a resultant slug;

advancing the punched film to a fitment attachment station;

moving the fitment from the fitment pick-up position to a fitment attachment position by causing a shuttle for moving the fitment to follow a cam plate defining a cyclodial curve; and sealing the web of film to the fitment.

44. The method of claim 43 including the steps of cleaning particulate matter out of the elongated housing tube by removing a bottom plate from the elongated housing tube.

* * * * *